US005464483A

United States Patent [19]

Avelis et al.

[11] Patent Number: 5,464,483

[45] Date of Patent: Nov. 7, 1995

[54] FLEXIBLE, COMPACT VIAL WASHER

[75] Inventors: Julian P. Avelis, Crete; Garrett W. McBrady, Homewood; William J. McBrady, Frankfort, all of Ill.

[73] Assignee: McBrady Engineering, Inc., East Hazel Crest, Ill.

[21] Appl. No.: 195,305

[22] Filed: Feb. 14, 1994

Related U.S. Application Data

[62] Division of Ser. No. 745,877, Aug. 16, 1991, Pat. No. 5,293,888.

[51] Int. Cl.[6] ..... B08B 3/02

[52] U.S. Cl. ..... 134/25.4; 134/21; 134/25.1; 134/25.2; 134/67; 134/82; 134/125; 134/131; 134/68; 134/33; 134/29; 134/30; 15/60; 15/304; 15/309.2; 198/606; 198/836.4

[58] Field of Search ..... 134/21, 25.1, 25.2, 134/25.4, 26, 29, 30, 32, 66, 67, 68, 82, 125, 126, 131, 152, 165, 33; 15/60, 304, 309.2; 198/462, 606, 836.4

[56] References Cited

U.S. PATENT DOCUMENTS

| | | | |
|---|---|---|---|
| 808,044 | 12/1905 | Groom | 99/361 |
| 1,457,352 | 6/1923 | Dreher | 198/461 |
| 1,513,628 | 10/1924 | Risser | 134/126 X |
| 1,569,191 | 1/1926 | Lathrop et al. | 134/68 |
| 1,604,505 | 10/1926 | Valerius et al. | 134/82 X |
| 1,891,425 | 12/1932 | Kronguest | 99/361 X |
| 1,915,482 | 6/1933 | Bartels | 193/606 X |
| 1,977,670 | 10/1934 | Darling | 134/131 X |
| 1,994,964 | 3/1935 | Schau | 198/606 X |
| 2,078,236 | 4/1937 | Chapman | 198/606 X |
| 2,229,605 | 1/1941 | Snyder et al. | 134/125 X |
| 2,910,992 | 11/1959 | Wilcox | 134/68 |
| 4,061,152 | 12/1977 | Babunovic | 134/152 X |
| 4,094,329 | 6/1978 | Evans | 134/152 X |
| 4,670,935 | 6/1987 | Bowler | 15/309.2 |

*Primary Examiner*—W. Gary Jones
*Assistant Examiner*—Sean Vincent
*Attorney, Agent, or Firm*—Eugene F. Friedman

[57] ABSTRACT

A method for removing exterior material from vials following a serpentine path through various steps of cleaning and drying. The movement of the vials may be limited to a predetermined path formed as an elongated opening in a sheet of material. The sheet may be replaced with a similar sheet with a different width of opening for bottles of differing sizes. The vials are rotated as they move along the path which may be accomplished by slight deviations in the straight sections of the elongated slot such as a zig-zag or sinusoidal wave. Changing the sheet can alter the number of straight path segments and thus the overall path of the vials through the equipment. The cleaning of the vials may include a washing with detergent, water rinsing, and air and vacuum drying. Air is drawn through the paths to produce a completely dry product. Liquid is removed from the vials' bottoms by a vacuum underneath the paths. Moving the vials at slightly different speeds, with higher speeds at the beginning of the paths, forces the vials towards each other, where they support each other in an upright position.

60 Claims, 8 Drawing Sheets

FLEXIBLE, COMPACT VIAL WASHER

This is a division of application Ser. No. 7/745,877, filed Aug. 16, 1991, now U.S. Pat. No. 5,293,888.

BACKGROUND

Often the exteriors of vials and other small bottles, even after they have received their contents, must undergo a thorough cleaning. Thus, for example, where the contents take the form of a powder, some of this material may adhere to the vials' exterior during the filling process. This can prove esthetically unacceptable.

Furthermore, the subsequent use of the vials may impose a requirement of cleanliness. In the ultimate, vials finding use in an operating room environment may have to have their exteriors extremely clean. These vials must undergo a very thorough cleaning prior to their use in this fashion.

Various types of cleaning and handling equipment have found use for vials and other containers. Thus, some cleaners have employed one or more star wheels which entrain the vials in pockets on their outer edges. The wheels then turn the vials or bottles through arcs of varying degrees during which time they may undergo cleaning. One star wheel bottle duster that has received acclaim appears in U.S. Pat. No. 4,701,973, issued on Oct. 27, 1987, to W. J. McBrady et al. This equipment finds use in cleaning bottles passing along an installed conveyor belt. Fitting over that conveyor, it removes the bottles, subjects them to a blast of ionized air, vacuum, and brushing and redeposits them on the same conveyor. However, even in this advancement, the bottles spend only a limited time within the cleaning apparatus. Thus, this equipment may prove marginal for conducting additional stages of cleaning such as detergent rinses, water rinses, and air drying.

The Seidenader Company of Germany has gone further and produced a unit employing two star wheels in tandem. A first wheel takes the bottles off a mass conglomeration pushed together by an end-feed mesh belt. The first wheel then rotates the bottles through approximately 270 degrees and subjects them to various cleaning operations. The bottles then transfer to the second wheel which, with somewhat more than 270 degrees, subjects them to further operations.

The use of two wheels, as in the Seidenader equipment, extends the distance the vials travel and thus the number of work stations that may operate upon them. However, it does not quite double the linear distance available from a single wheel since the two wheels require a distance between them to transfer the bottles from one to the other. Moreover, the use of two wheels requires an extensive horizontal area for the machine. This in turn requires more equipment and entails greater expense. Furthermore, the openings in the wheels themselves and the exact positioning of the work-stations appears suited for a single diameter of vial. The equipment also does not illustrate a facile interchange to permit its use for larger or smaller vials than that originally intended.

Furthermore, the mesh end-feed belt which accumulates a large number of vials together over a large area also provides difficulty in controlling the containers. Vials typically have a narrow width. As a consequence, knocking against each other in this arena may result in a number of them falling over. This clearly proves undesirable at the intake of the first star wheel.

In fact, the handling of a large number of vials and other containers represents an important task in itself. The Garvey Corporation of Blue Anchor, N.J., has a "Bi-Flo" unit (covered by U.S. Pat. No. 4,401,207) in which adjacent conveyor belts can move in either the same or opposite directions. This equipment can take items feeding in from one or more sources and provide them at a single or multiple outlets.

A somewhat similar type of equipment appears as the Unscrambler from McBrady Engineering, Inc. This equipment employs several adjacent conveyor belts moving in the same or different directions. This unit takes a large number of incoming containers and provides them at a discharge port. As the units move over conveyors traveling in the same direction, it finds that the speed of each succeeding conveyor has increased. This gradual acceleration unscrambles and separates the conveyors for the discharge port. A subsequent reverse conveyor prevents jamming by removing excess containers that might otherwise clog the outlet.

Although these units facilitate the handling of containers in general, they have not found applicability to improving the equipment which actually cleans and dries vials. The search continues for such equipment which can wash and dry vials thoroughly but utilizes a minimum of space and equipment. Furthermore, the handling of vials in a facile fashion also constitutes a continuing objective.

SUMMARY

An improved vial washer results, in general, where the equipment provides a serpentine path which folds upon itself. The vials on this path may undergo various steps of cleaning and drying to create a product suitable for their intended use.

Specifically, such a washer will include a frame which typically provides structural support for the washer's components. A motive device, coupled to the frame, then effectuates the movement of the vials.

A guide couples to the frame and serves to limit the motion of the vials to a predetermined path. This path should include a plurality of path segments. Substantially the entire length of each path segment lies at a substantially constant distance to substantially the entire lengths of the other path segments. This means, in effect, that the path folds upon itself with segments lying concentric, parallel, or the like to each other. This allows the employment of several stages of cleaning without requiring an extensive area or material for the equipment itself.

Additionally, the predetermined path includes connecting segments. The number of such segments, of course, amounts to one less than the number of path segments. Each connecting segment serves to connect two path segments. This provides the folding back upon itself of the path discussed above.

Lastly, the vial washer requires some type of cleansing device. This last component couples to the frame and removes material from the vials' exterior.

Without the cleansing device, the equipment provides an efficient and economical manner of handling vials. It may do so for any number of other purposes even including accumulating them on a path prior to other processing steps such as filling.

The method of controllably moving vials includes first actually moving the vials. Controlling the vials' movement results in limiting the motion of the vials to a predetermined path. The path includes first a plurality of path segments with substantially the entire length of each of the path segments lying at a substantially constant distance to substantially the entire length of the other path segments. Furthermore, the path includes connecting segments, one less in number than the path segments, with each connecting segment joining two path segments together. Were the method also to include washing the vials, then material should undergo removal from the exterior of the vials while on the path.

Stated alternately, a washer for vials will include, in addition to the frame, a motive device, coupled to the frame, for moving the vials and a power device, coupled in turn to the motive device, for while operating, causing the motive device to move the vials. Furthermore, a guide couples to the frame and has the purpose of limiting the motion of the vials to a predetermined path. Furthermore, the guide supports the vials in an upright position while on the path. The guide includes a substantially rigid sheet of material with an elongated opening in it defining the predetermined path. The opening has a width slightly larger than the vials. To achieve flexibility, the sheet with the elongated opening can undergo removal from the frame without affecting the motive device.

Lastly, the washer includes a cleansing device which couples to the frame. It removes material from the exterior of the vials. Where the equipment serves only to handle vials for purposes other than cleaning, the cleansing device does not form part of the machine.

The method of controllably moving the vials again involves moving the vials. While moving, the motion of the vials should be limited to a predetermined path formed as an elongated opening in a substantially rigid sheet of material. The opening must have a width slightly larger than that of the vials. Lastly, the vials should receive support in an upright position while in the opening.

Again, this method serves to move vials in a predictable, controlled fashion should that represent an important task. Cleaning the bottles, when desired, involves removing material from the vials' exteriors. That often would take the form of a liquid wash and may include a detergent and subseqently drying the vials.

DETAILED DESCRIPTION

Figure 1:
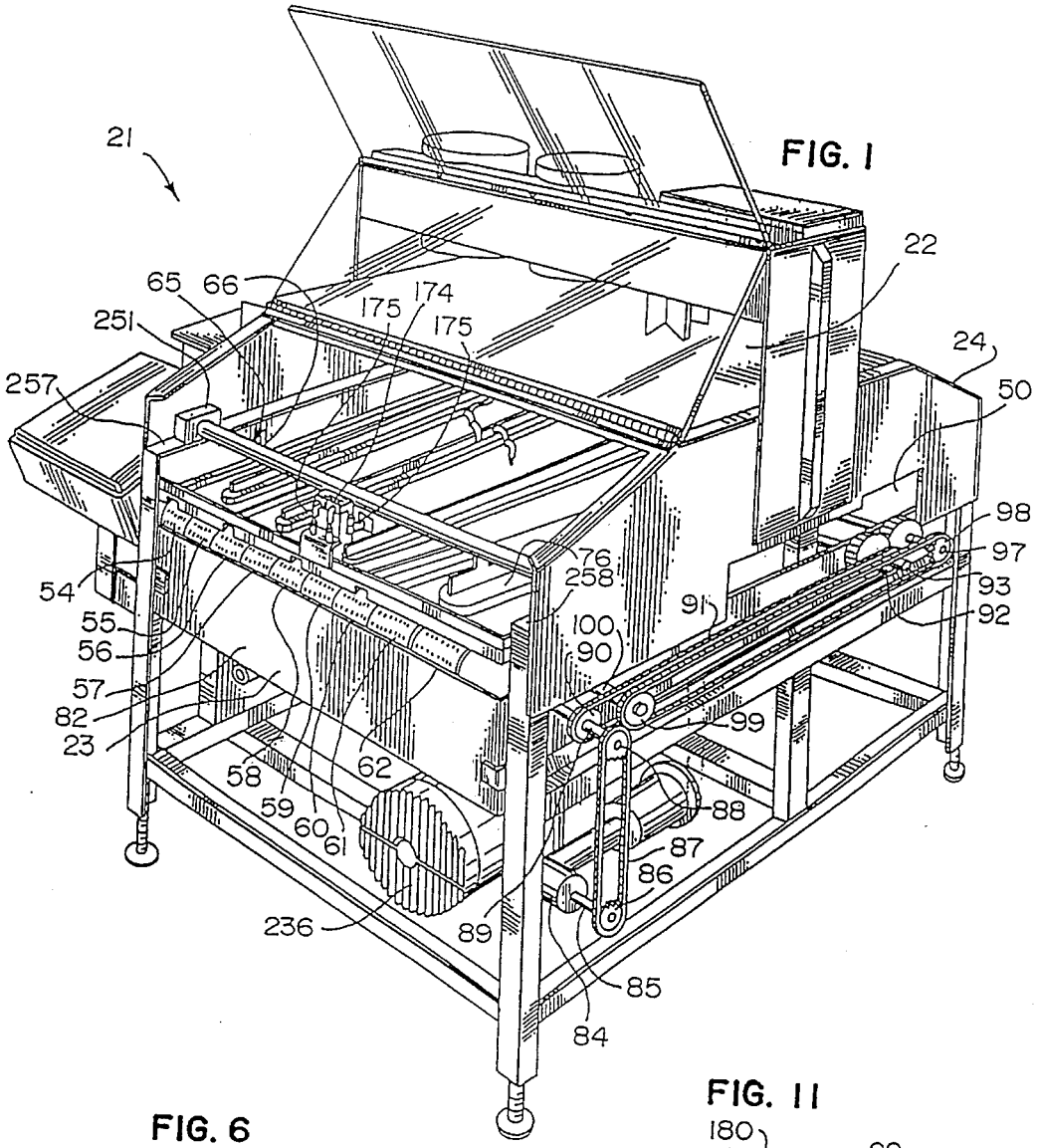
FIG. 1 gives a left, frontal perspective view of a vial washer having a serpentine path and several stages for cleaning vials.
Figure 2:
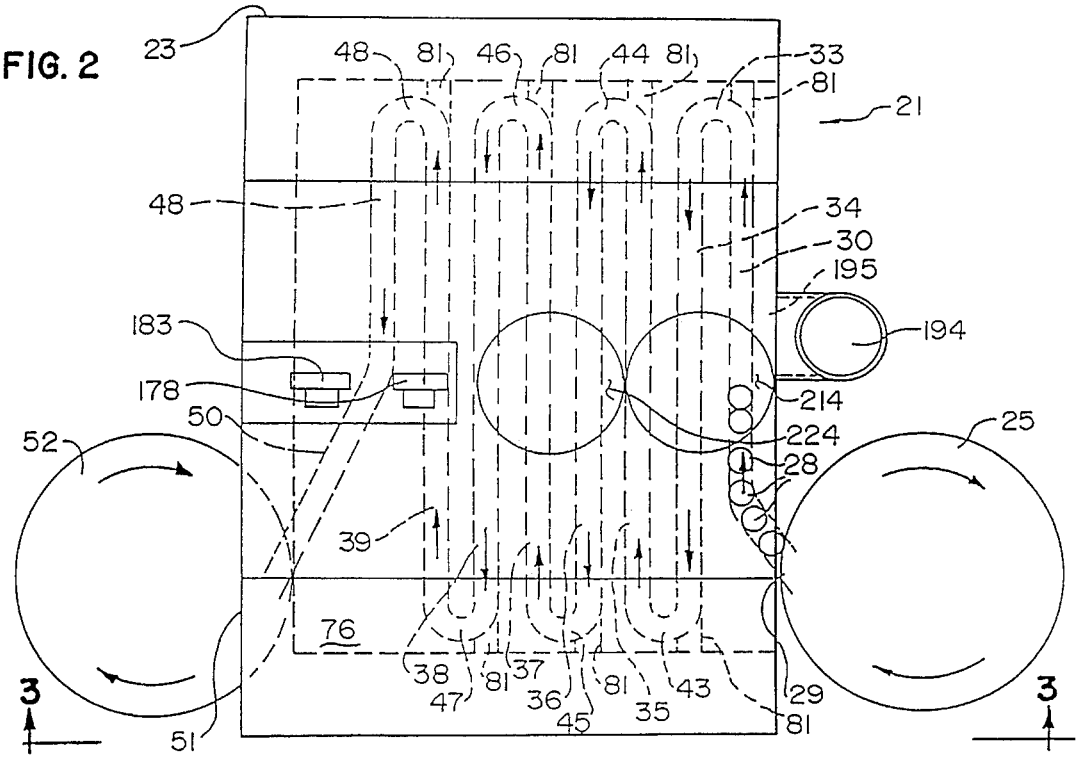
FIG. 2 gives a top plan view of a vial washer which has eight straight path segments between the inlet and outlet. The front of the washer appears at the bottom of the figure.
Figure 3:
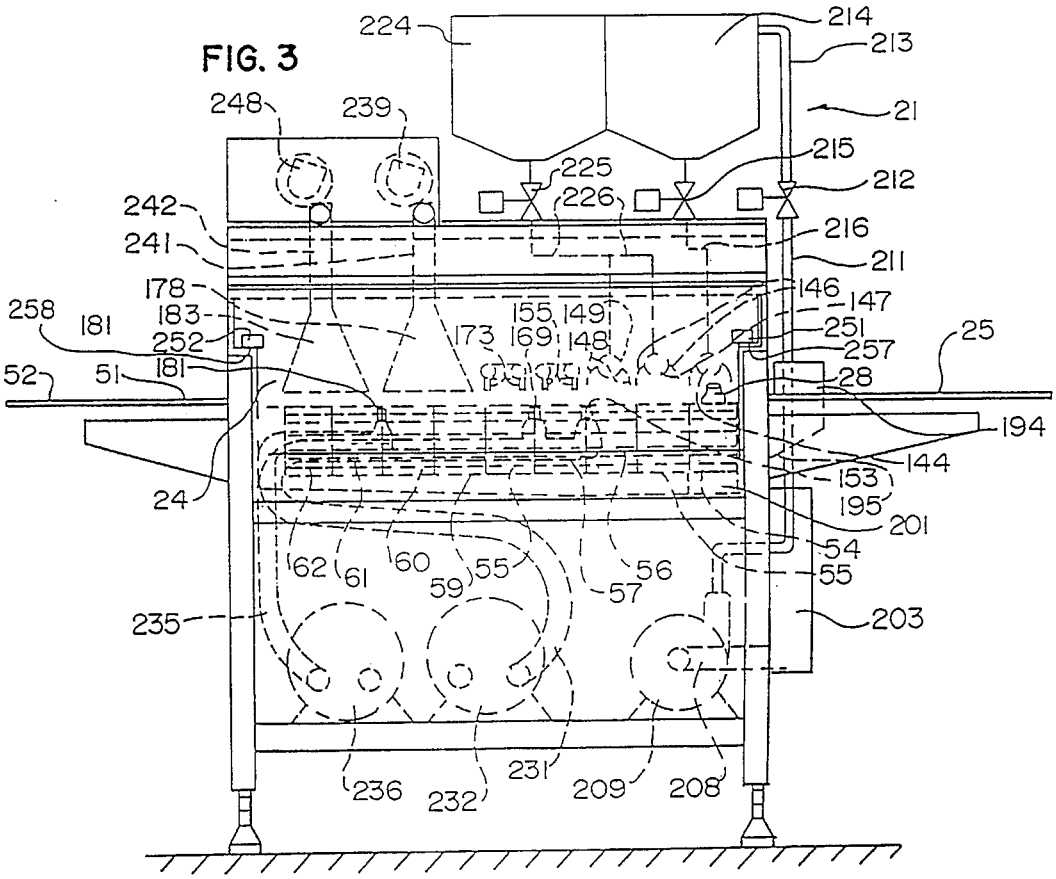
FIG. 3 gives a rear, elevational diagrammatic view along the line 3—3 of FIG. 2 showing the various components for moving and cleaning vials.

FIG. 1 shows a vial washer generally at 21 having the hood 22 which encloses the actual vial moving and cleaning mechanisms. The bottles enter the left of the washer in FIG. 1 from any convenient source. FIGS. 2 and 3 shows the rotating wheel 25 which holds a supply of vials that will undergo cleaning in the washer 23. The equipment shown, however, may simply take vials off a conveyor line from other mechanisms such as filling equipment.

Seen best in FIG. 2, the vials 28 enter through the opening 29 from the infeed table 25. From there they travel on to the first straight path segment 30 which carries them towards the front 23 of the washer 21. Near the front 23 the connecting path segment 33 changes their direction by 180 degrees, and they travel along the straight path segment 34 toward the rear 24. In a similar fashion, the bottles travel along the straight path segments 35 to 39 joined together by the curved connecting segments 43 to 48. They then enter onto the last straight path segment 49 which carries them to the discharge path 50, through the opening 51, and onto the outfeed table 52. As seen more clearly in FIGS. 3 and 4, the washer 21 includes the nine belts 54 to 62 to actually move the vials 28 on the segments 30 and 33 to 49. The belts move in the directions indicated on FIG. 4 Thus the first belt 54 moves from the rear 24 to the front 23. The second through seventh belts 55 to 60 move in the opposite directions from the immediately preceding belts. The eighth belt 61 moves in the same direction as the seventh belt 60 while the ninth belt 62 moves in the direction opposite to the eighth belt 61 toward the outlet 51 and onto the discharge table 52.

Figure 5:
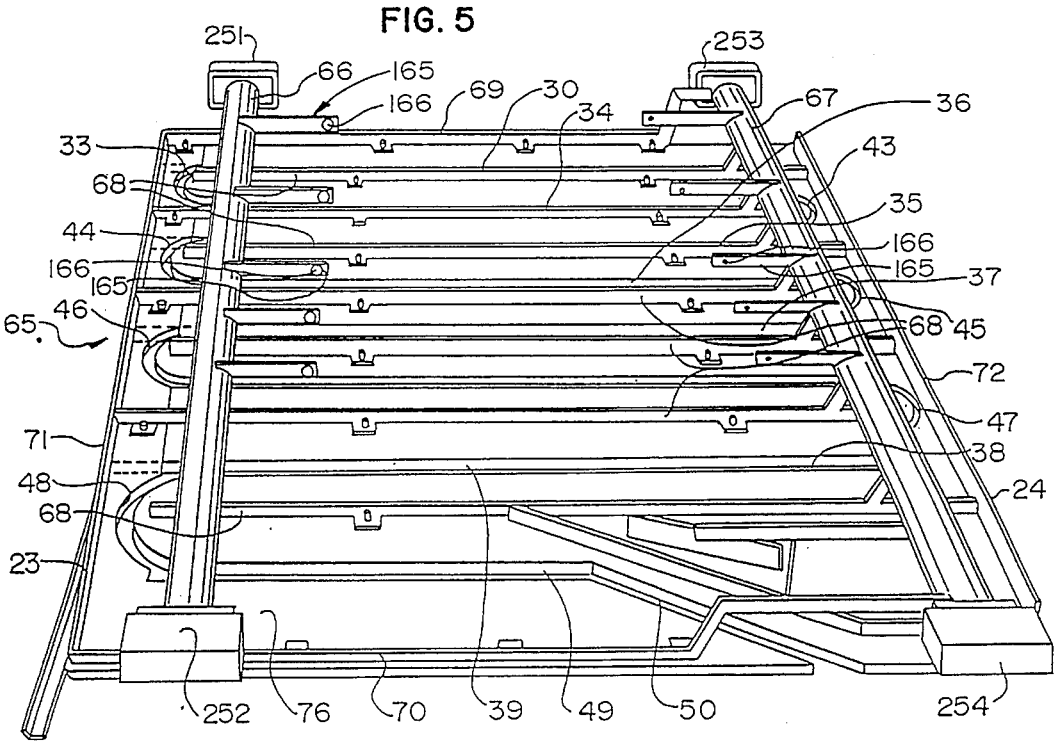
FIG. 5 shows a change piece with an elongated slot having a width suitable for a particularly sized vial and also defining the path followed by the vials through the washer.

As indicated above, the belts 54 to 62 serve to provide motive power to the vials through the washer 21. However, the change piece seen generally as 65 in FIG. 5 serves to actually define the straight path segments 30, 34 to 39, 49, and 50, as well as the connecting curved segments 33 and 43 to 48. To do this, the change piece 65 includes the crossbars 66 and 67 which attach to the metal support brackets 68 and the end brackets 69 and 70. In turn, the various brackets 68 to 70 attach to the side brackets 71 and 72.

The brackets 68 to 72 then attach to the sheet of high-density polyethylene 76 which may be composed of one or more sections. The brackets 68 to 72 serve to hold the several pieces, if present, of the polyethylene together to form the sheet 76 and to give it rigidity. An opening in the form of an elongated, serpentine slot within the sheet of polyethylene 76 then defines the path segments 30, 34 to 39, 49, and 50 and the connecting segments 33 and 43 to 48. These segments then determine the path of the bottle through the washer 21. Actually moving the bottles through the elongated slot formed in the plastic sheet 76 requires the action of the belts 54 to 62 seen in FIG. 4. The slot merely serves to guide the bottles as the belts move them.

Figure 6:
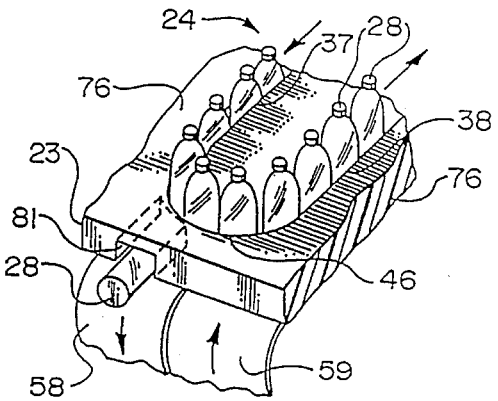
FIG. 6 provides an enlarged view of the portion of the vial washer of the prior figures in which vials move in one direction on one belt and transfer over to moving in the opposite direction on an adjacent belt.

An example of a vial crossing from a belt moving in one direction and onto a belt moving in the opposite direction appears in FIG. 6. There the belt 58 moves the vials 28 toward the front 23 of the machine. It moves from the straight path segment 37 and into the curved connecting segment 46 which brings it from the belt 58 to the belt 59. Then, the belt 59 moves it toward the rear of the machine where it receives guidance from the straight path segment 38. As also seen in that figure, the sheet 76 includes the small cut-out 81 at its end over the belt 58. Should a vial happen to fall while on this path segment, it could get caught in the curved connecting segment 46 and block the entire path for all the vials. The cut-out 81 allows a vial 28 that has fallen to pass outward and entirely out of the path formed by the various path and connecting segments. As seen in FIG. 1, the catch pan 82 would retain all such fallen vials that had moved out toward the front of the machine. A similar catch pan sits at the rear 24 of the vial cleaner. FIG. 2 shows such an opening 81 at the end of each straight path segment.

Figure 7:
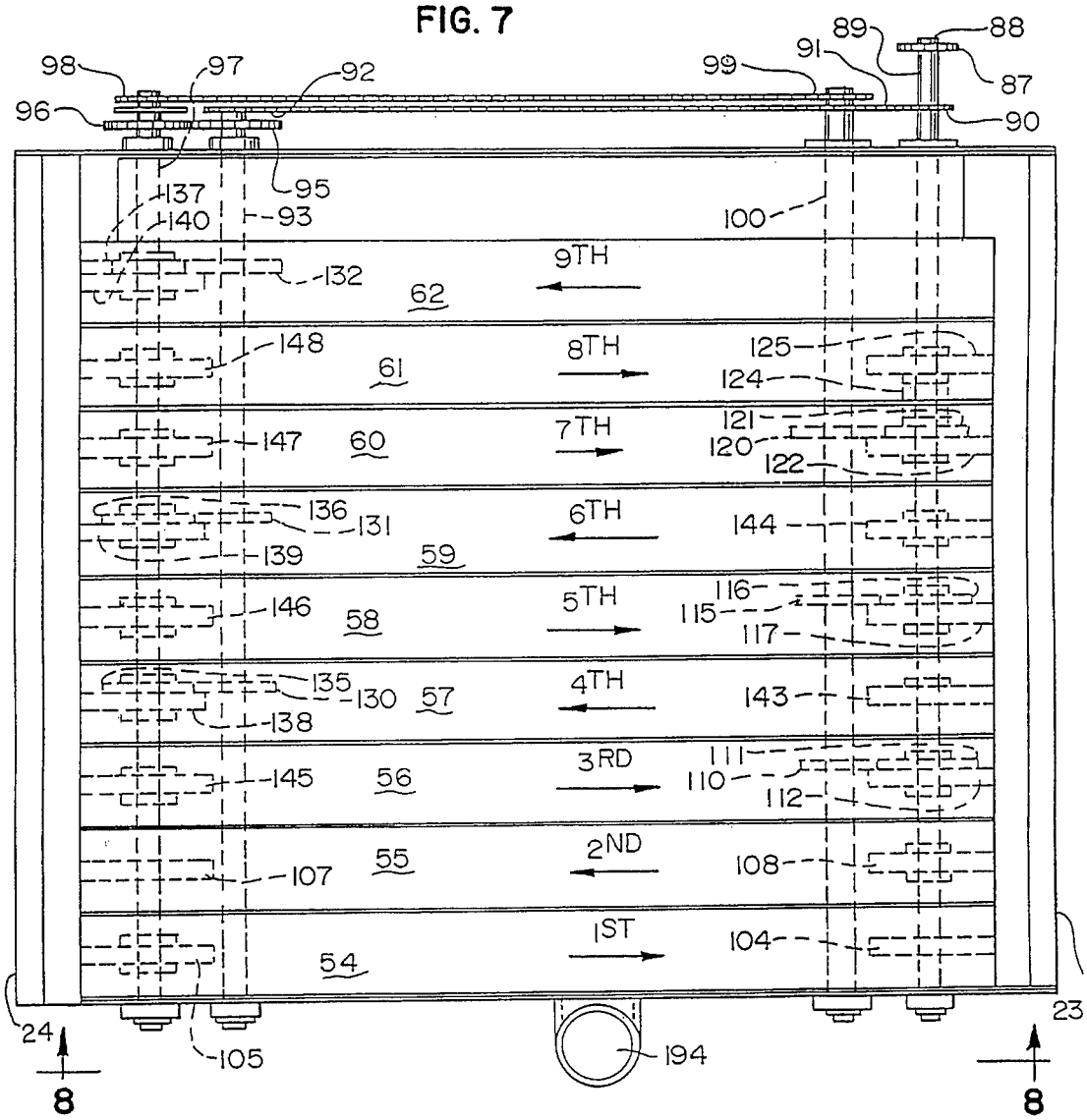
FIG. 7 gives a top plan view of the various belts of the washer of the prior figures and the mechanism for providing them with linear motion of differing speeds.

However, to help minimize the number of vials that may fall over and move out of the cleaner 21 in this fashion, the belts 54 to 62 may, in fact, not move at a uniform speed (even considering that they do travel in opposite directions). In fact, as seen in FIG. 7, each of the belts 54 to 60 move slightly slower than the belt preceding it. (Again, the belts 60 and 61 move in the same direction and at the same speed. In the embodiment shown, they may and should receive consideration essentially as a single belt.) A belt moving faster than a succeeding belt tends to force the vials forward and against those in front. This pushing of the vials together helps them provide mutual support to each other to minimize, if not eliminate, their toppling over. Thus, in FIG. 7, the first belt 54 moves at about 17.5 r.p.m. Similarly, the second belt 55 moves at 16.9 r.p.m.; the third belt 56 at 16.5 r.p.m.; the fourth belt 57 at 16.1 r.p.m; the fifth belt 58 at 15.7 r.p.m.; the sixth belt 59 at 15.3 r.p.m.; the seventh and eighth belts 60 and 61 at 14.9 r.p.m.; and the ninth belt 62 at 14.5 r.p.m.

Figure 8:
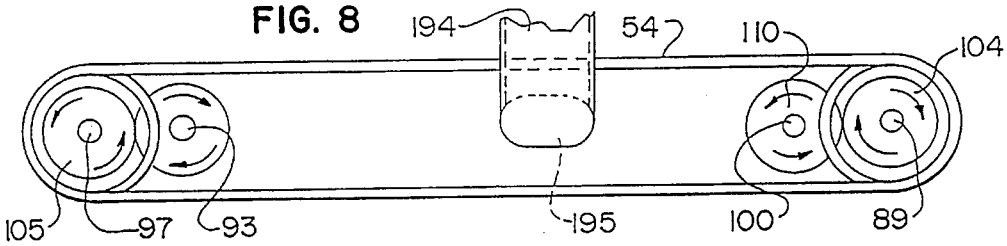
FIG. 8 gives a side elevational view along the line 8—8 of the belts and their drive mechanism of FIG. 8.

The mechanism for achieving the different belt speeds appears in FIGS. 7 and 8. As seen in FIGS. 1 and 7, the power to drive the belts derives from the motor 84 driving the shaft 85 which has attached to it the sprocket wheel 86. The wheel 86 in turn drives the chain 87 which thus provides power to the sprocket wheel 88 and thus the drive shaft 89. The shaft 89 in turn drives the sprocket wheel 90 and thus the chain 91 which thus turns the sprocket wheel 92 and the left inner shaft 93. The gear 95 driven by the shaft 93 in turn rotates the gear 96 and the left outer shaft 97. The sprocket wheel 98, turned by the shaft 97, rotates the shaft 99 and with it the right inner shaft 100. Tracing these connections shows that, with the motor 84 driving the drive shaft 89 to the right in FIG. 7, the rear inner shaft 93 also turns to the right, while the left outer shaft 97 (and the right inner shaft 100) both turn to the left. In turn, the right outer drive shaft 89 directly couples to and turns the wheel 104 to the right causing the belt 54, with which it has direct contact, to move to the right as indicated by the arrow on that belt. The wheel 105 sits as an idler about the shaft 97 and permits the motion of the belt 54 as indicated above. The rotation of the shaft 97 to the left has virtually no effect upon the wheel 105.

Similarly, the wheel 107 directly couples to the left outer shaft 97 and moves to the left with it, causing the belt 55 to also move to the left. Again, the wheel 108 simply acts in an idler role. As seen from above, the ratio of the teeth on the wheels 90, 95, and 96 determine the ratio of the turns of the right outer (or drive) shaft 89 to the left outer shaft 97. The appropriate selection of these gear ratios permit the determination of the speed of the belt 55 compared to that of the belt 54.

To drive the belt 56, the gear 110 has a fixed attachment to the forward inner shaft 100. This in turn couples to the gear wheel 111 which has a fixed connection to the wheel 112. Thus, the wheel 112 turns to the right at the same speed as the gear wheel 111 but may slip around the right outer (drive) shaft 89. As a result, the speed of the drive wheel 111 depends upon the speed of the right inner shaft 100 as well as the relative gear ratios between the gear wheels 110 and 111. Selecting in particular the ratio between the gear wheels 110 and 111 permits the selection of the rotational speed of the drive wheel 112 and the speed of the belt 56 to the right. Similarly, the gear wheel 115 drives the gear wheel 116 and the drive wheel 117 which moves the belt 58 to the right at the desired speed. Similar remarks apply to the gear wheel 120 interacting with the gear wheel 121 and the drive wheel 122 to drive the belt 60 to the right. The coupling 124 rotationally connects the drive wheel 125 to the drive wheel 122 so that the belt 61 also moves to the right at the same speed as the belt 60.

Similar remarks apply to the driving of the belts 57, 59, and 62 to the left at the differing speeds. Thus, the gear wheels 130, 131, 132 connect, with differing respective gear ratios, to the gear wheels 135, 136, and 137 which couple to the wheels 138, 139, and 140. This actually drives the belts 57, 59, and 62. The pair combinations of gear wheel-drive wheel 135–138, 136–139, and 137–140, may freely slide over the left outer shaft 97. As seen in the figure, the wheels 143 to 148 constitute idlers at the opposite ends of their respective belts from the driving wheels.

Figure 4:
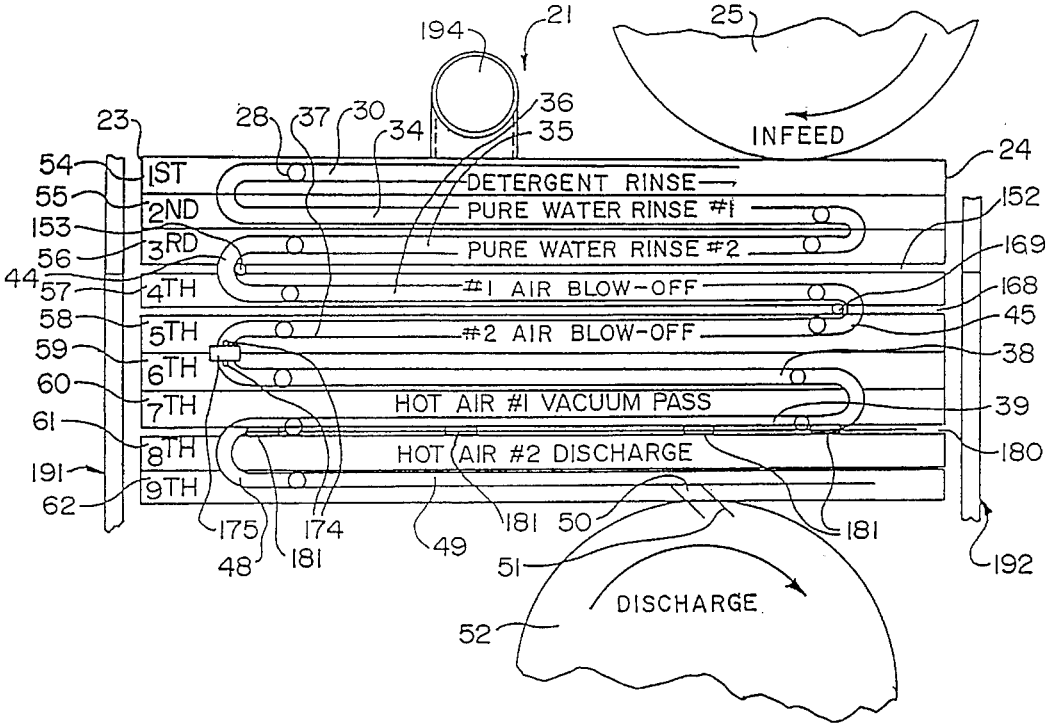
FIG. 4 diagrams the various stages of cleaning the vials in the prior figures.

As shown in FIGS. 3 and 4, the vials 28 on the first path segment 38 (moved by the first belt 54) receive a detergent rinse from the nozzles 143 on the detergent manifold 144. As they pass to the second path segment 34 (moved by the second belt 55), they receive the first pure water rinse from the nozzles 146 on the manifold 147. The second rinse comes from the nozzles 148 on the manifold 149 on the third path segment 35. The bottles then cross from the third path segment 35 to the fourth path segment 36, and as they do so, they also pass over the gap 152, as seen in FIG. 4, between those two belts. The gap 152 attempts to isolate the belts 54 to 56, which have moisture on them due to the detergent and water rinses, from the subsequent belts 56 to 62 which attempt to remain successively drier. To help remove moisture from the bottles as they pass over between the third and fourth belts 56 and 57 respectively, the equipment includes the first bottom blow-off vent 53 which attempts to dislodge water that may adhere to the bottles' bottom surfaces. On the fourth path segment 36 (moved by the fourth belt 57), the bottles receive their first blast of overhead drying air from the nozzles 155. The nozzles 155 actually take the form of elongated openings which extend much of the length of the fourth path segment 36. The arrangement of the components relative to the two belts 56 and 57 appears in the enlarged view of FIG. 9. Seen there the vials in the third path segment 35 pass under the nozzles 148 of the pure water rinse manifold 149. Then, in FIG. 10, the manifold 149 includes the four nozzles 148 on each side so that the bottle receives a spray of water from two directions. The water manifold 149 receives its liquid through the sanitary hose connection 159 from Tri-Clover, Inc., in Kenosha, Wis. The ends of the manifold 149 have a covering of the clamping seals 160, also produced by Tri-Clover. The clamping seals, when removed, permit the thorough cleaning and sanitizing of the manifold 149. The seals themselves also submit to sterilization.

Figure 9:
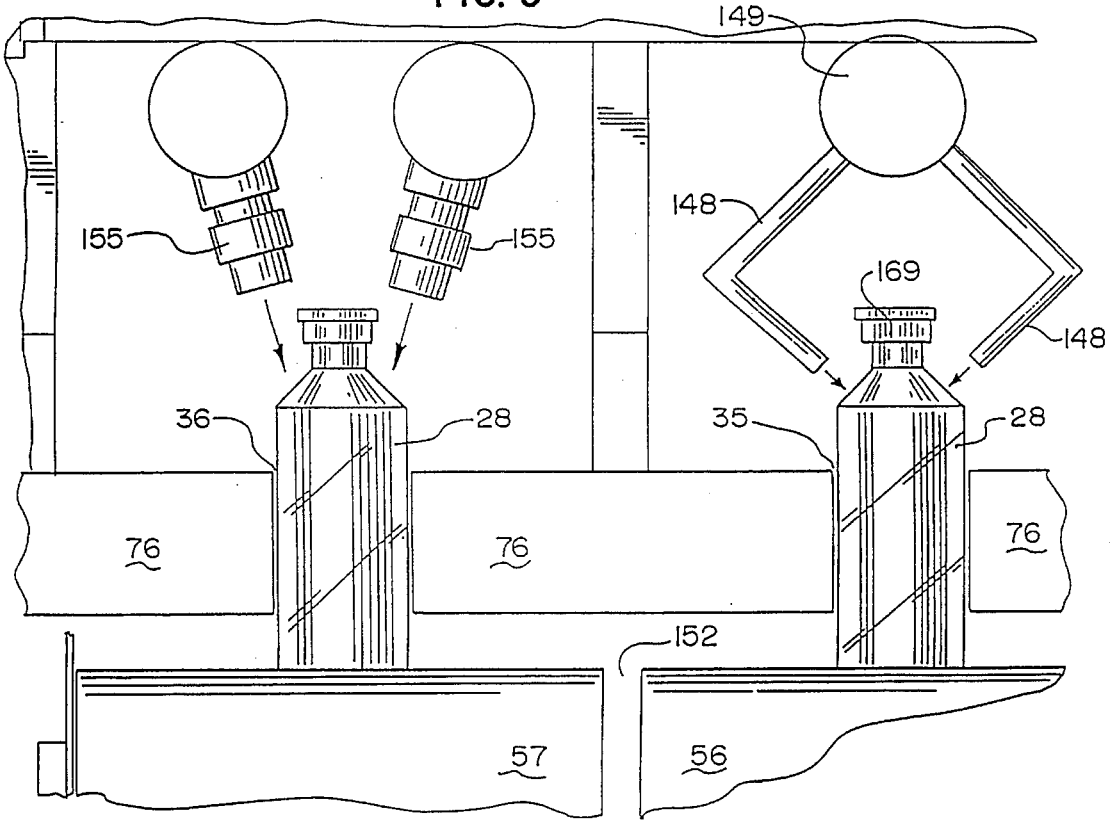
FIG. 9 provides an enlarged rear elevational view of the portions of the vial washer of the prior figures which apply a cleansing rinse of water and a subsequent stream of drying air.

The manifold 149 has attached to it the tabs 161 with the three indentations 162 to 164 on each of them. These tabs 161 permit the attachment of the manifold 149 to the support brackets 165 affixed to the crossbars 66 and 67 in FIG. 5. The thumb-screws 166 pass into one of the indentations 162 to 164 on each side to hold the manifold 149 in place over the appropriate path segment. Selecting the appropriate pair of the indentations 162 to 164 allows the placement of the manifold 149 at the appropriate height above the vials 28 as seen in FIG. 9. Basically, the nozzles 148 should typically spray the water near the tops of the vials 28. They should, however, generally avoid splashing the liquid onto the seals 169 which often do not need cleaning and should avoid the rinses.

Figure 10:
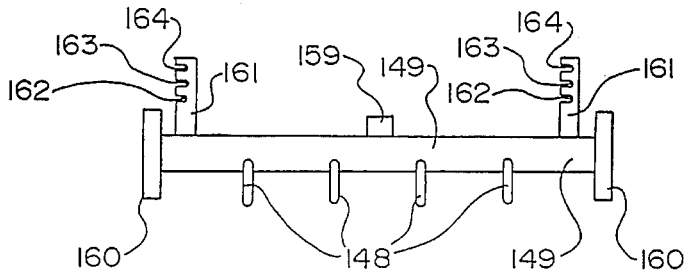
FIG. 10 shows a manifold useful for either a detergent or water rinse for the vials as well as its connection to the frame.

As seen in FIG. 10, the indentations 162 to 164 point in the same direction on both the tabs 161. This facilitates their attachment to and removal from the change piece 65 at the appropriate height; with the indentations 162 to 164 pointing in the same direction, the operator need only loosen the thumbscrews 166, insert the tabs 161 with the appropriate indentation 162 to 164 passing around the thumbscrews 166. Tightening the thumb-screws 166 then secures the manifold 149 at the correct height. The same type of manifold 149 may find use for both of the water rinses on the second and third path segments 34 and 35 as well as the detergent rinse on the initial path segment 30.

Returning to FIGS. 2 and 4, the vials on the fourth path segment 36, after receiving their first air blow-off, transfer at the connecting segment 45 to the fifth belt 58. Again, in travelling from the fourth belt 57 to the fifth belt 58, they must cross the gap 168 which again attempts to keep the moisture on the prior belts from the succeeding belts. Furthermore, the bottles cross over the second bottom blow-off 169 located under the gap 168. The blow-off 169 also tries to remove any remaining loose liquid on the bottles. On the fifth path segment 37, the vials receive a further blast of air from the nozzles 173. The vials then cross from the belt 58 to the belt 59 where they may receive a further blast of air from the nozzles 174 attached to the block 175 as seen in FIGS. 1 and 4. The vials then pass along the path segment 38 provided by belt the 59 and then the path segment 39 provided by the belts 60 and 61. Initially, while there, they receive the flow of hot air from the blower 178 in FIG. 3.

Figure 11:
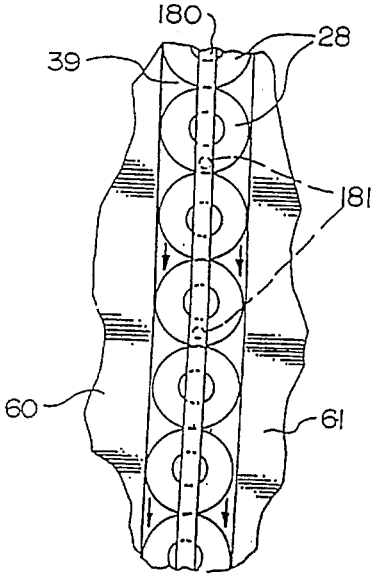
FIG. 11 shows two belts moving in the same direction carrying vials over a gap which contains suction nozzles.

Furthermore, on the path segment 39 they actually sit over the gap 180 between the belts 60 and 61. As recalled from above, the belts 60 and 61 both move in the same direction. As the bottles move over the gap 180, they have applied to their bottoms a suction through the vacuum ports 181. FIG. 11 shows the vials 28 moving on the belts 60 and 61 over the gap when 80 with the vacuum outlets 181. The connecting segment 48 then transfers the vials onto the path segment 49 (with motive power from the belt 62) where they receive a second stream of hot air from the blower 183 in FIG. 3. They may then move out the discharge chute 50, through the outlet 51, and onto the discharge table 52.

The last four belts 59 to 62, because of the air blow-offs both above and below, should remain basically dry. If they became wet, the bottles passing through the discharge chute 50 might retain some moisture on their bottoms. To help make sure that these belts remain dry, the washer includes the belt blow-off 191 at the front 23 of the washer and the blow-off 192 at the rear 24. These help dry any moisture remaining on the fourth through ninth belts 57 to 62 that might pass over from the first three belts 54 to 56 which actually receive the stream of detergent and water rinses.

Furthermore, to keep moisture away from the last belts 60 to 62, the washer 21 includes the vacuum connection 194 which can couple to a source of negative pressure at the installation site. Or, a separate vacuum pump can attach to the vacuum connection 194. The actual vacuum at the connection 194 draws air and entrained vapor through the opening 195, perhaps best seen in FIG. 8. The opening 195 sits between the upper and lower levels of the belts and lies adjacent to the first belt 54. It draws air across the belts starting from the discharge end. The initially dry air then moves across the belts 62 down to 54 and then out through the opening 195. In this fashion, the moving air takes water vapor which it may have received from the earlier belts 54 to 57 and draws it away from the later belts 58 to 62 which should remain dry. This movement of air in the direction from the dry, later belts to the earlier belts, which actually receive the detergent and water rinses, helps to keep the last belts dry. Bottles moving on the last belts may thus remain free of undesired moisture.

Figure 12:
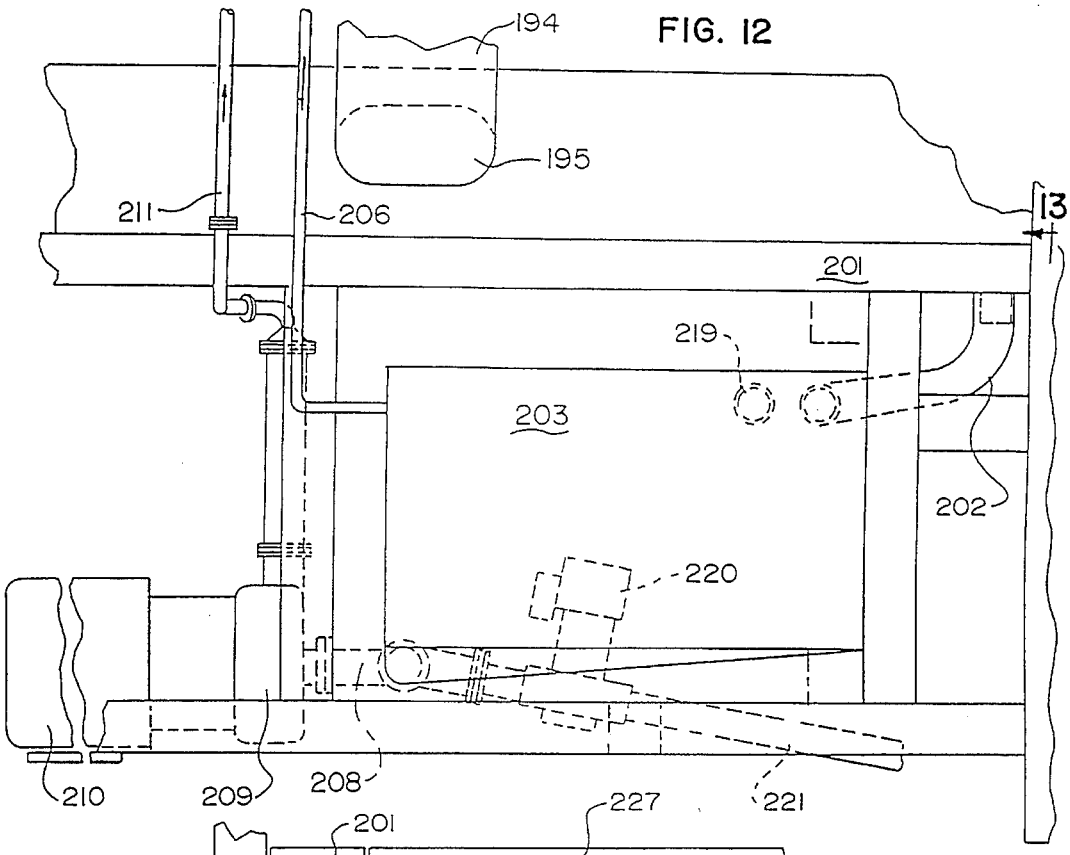
FIG. 12 gives a left side elevational view of the lower portion of the vial washer of FIG. 1 showing various connections for transporting the liquids used.
Figure 13:
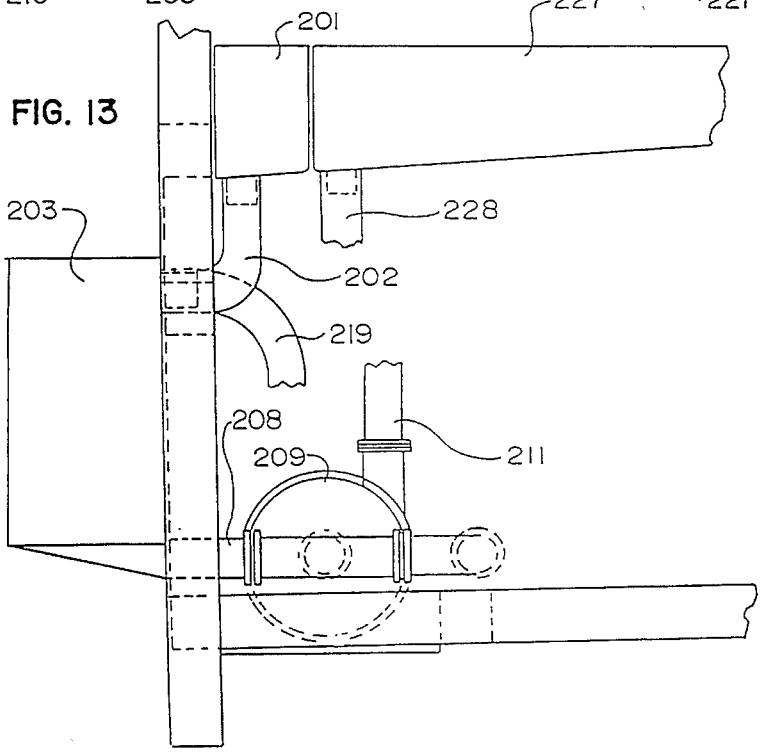
FIG. 13 gives a front elevational view along the line 13—13 of the lower portion of FIG. 12 also showing various conduits for liquids.

The components for supplying the various stages of vial cleaning in the washer 21 appears in FIGS. 3, 12, and 13. Focusing on the latter two figures, the detergent catch pan 201 sits under the first belt 54. It serves to catch the detergent rinse liquid after it sprays from the manifold 143 onto the vials 28, and through the belt 54. To allow liquid to pass through, the belts 54 to 62 have an open grid. Convenient belts of this type are obtainable as Uni-Light 0 (18 percent open) from Rainbow Uni of Ridgewood, N.Y.

The liquid from the catch pan 201 flows along the conduit 202 and enters the detergent mix tank 203. The tank 203, in addition to the detergent from the catch pan 201, also receives fresh water from the conduit 206. As need be, the contents of the tank 203 may also receive the actual detergent, all of which receives a thorough mixing. The detergent mixture departs the mix tank 203 and then travels along the conduit 208 and into the pump 209 operated by the motor 210. The pump 209, in turn, pushes the detergent liquid up the conduit 211, through the solenoid 212, along the tubing 213, and into the detergent reservoir 214. From there, it passes through the solenoid 215, when open, and along the conduit 216 to the detergent manifold 143.

The fluid from the detergent reservoir 214 flows under gravity onto the vials 28. This prevents excessive force against the vials which could possibly topple them or even possibly force liquid up under the seal. Where neither of these conditions represent a problem, then the pump 209 could connect directly to the manifold 144 and eliminate the need for the reservoir 213.

Any overflow from the mix tank 203 may pass out through the tube 219 to a drain. When it becomes desirable to empty the mix tank 203 entirely, the solenoid 220 may open to allow the fluid to pass through the conduit 221 to a drain.

Under certain conditions, the detergent liquid should not find reuse after it has once passed over the vials. Then, the tube 202 would simply provide a direct outlet from the catch tank 201 to the usual drain. Then, the mix tank 203 would simply combine fresh water and detergent to provide it along the path previously shown.

The water rinse proves much simpler. Water of the desired purity, for example injection quality, may enter the water reservoir 224. From there it passes through the solenoid 225, when open, and down through the conduit 226 into the water manifolds 147 and 149. After passing over the vials it enters the water catch pan 227 in FIG. 13 and passes through the conduit 228 directly to the drain. It typically does not find reuse.

Air for the blower jets 155 comes through the conduit 231 from the blower motor 232. Similarly, the suction for the vacuum inlets comes from the conduit 235 connected to the motor 236, which may simply represent a duplicate of the blower motor 232 but operating in reverse. Lastly, the blowers 178 and 183 receive the air from the motors 239 and 240. This air, now under pressure, passes across the heaters 241 and 242, respectively, and on to the respective path segments.

The various operational components shown in the figures may operate under an almost unlimited array of logic controls. Thus, the operator may wish for none of the other components to operate when the belts 54 to 62 do not move. Furthermore, he may not wish for liquid to pass through the solenoid 211 into the detergent reservoir 213 unless the solenoid 215 allows some to pass through to the vials. Furthermore, he obviously would not want to have the detergent motor 209 operate with the solenoid 211 closed. In addition, when turning off the blowers 178 and 183, he may wish to pass air through the heaters 241 and 242, even after they have turned off, to cool them down. Yet, to keep this additional hot air off the vials, the output from the heaters 241 and 242, with the remainder of the table not operating, may be diverted away from the vials. Furthermore, the washer may incorporate various lights and alarms that will operate under various conditions.

The vial washer 21 shown in the figures, has substantial flexibility to allow it to adapt to different vials or to even different cleaning schemes. To provide this flexibility, the change piece 65 shown in FIG. 5 includes the feet 251 and 252 at the ends of the crossbar 66 and the feet 253 and 254 attached to the crossbar 67. These feet, made of smooth, high-density polyethylene, rest upon the rails 257 and 258 seen in FIGS. 1 and 3. The feet 251 to 254 support the entire weight of the change piece 65 when within the washer 21. As seen in FIGS. 1 and 3, this allows the change piece 65 to undergo facile removal from the washer 21. To do this simply involves removing the manifolds, such as the water manifold 149, from the support brackets 165. This then allows the removal of the change piece 65 simply by pulling it forward in FIG. 1. The washer 21 may then receive another change piece adapted to other cleaning situations.

Figure 14:
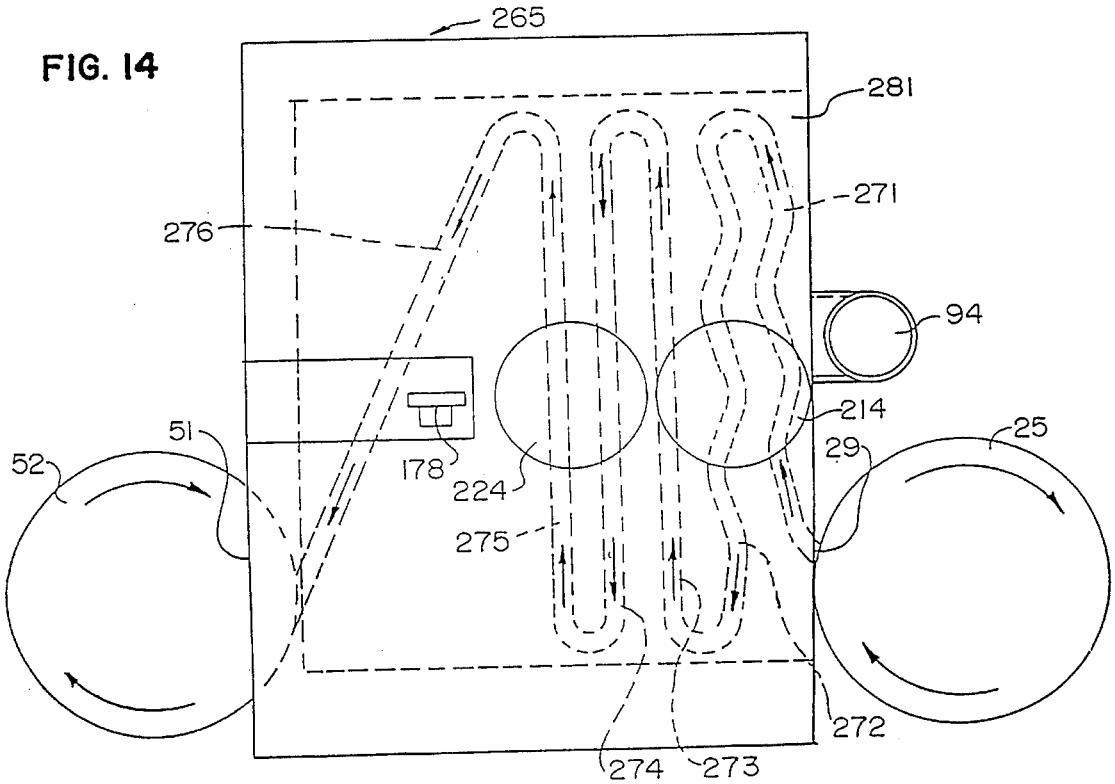
FIG. 14 gives a top plan view of a vial washer similar to that of the prior figures but using only six passes and employing a sinusoidal path on the first two segments to achieve bottle rotation.

If the vials undergoing washing only require six passes as opposed to the eight shown in the prior figures, they may use the change piece 265 shown diagrammatically in FIG. 14. As seen there, the vials come off of the infeed table 25 into the inlet 29 and along the first path segment 271. They would then transfer in the usual fashion to the succeeding path segments 272 to 276 and through the outlet 51 onto the discharge table 52. As seen in FIG. 14, the first two path segments 271 and 272 in the change piece 265 have a sinusoidal shape to them. As the vials, when moved by the belts underneath, make contact with the solid walls of the change piece 281, they undergo a rotation. This allows the detergent rinse and the first water rinse to thoroughly cleanse the entire circumference of the vials; no portion will remain in contact with a bottle on either side or with the wall itself. The rotation exposes all 360 degrees of the vial.

Figure 15:
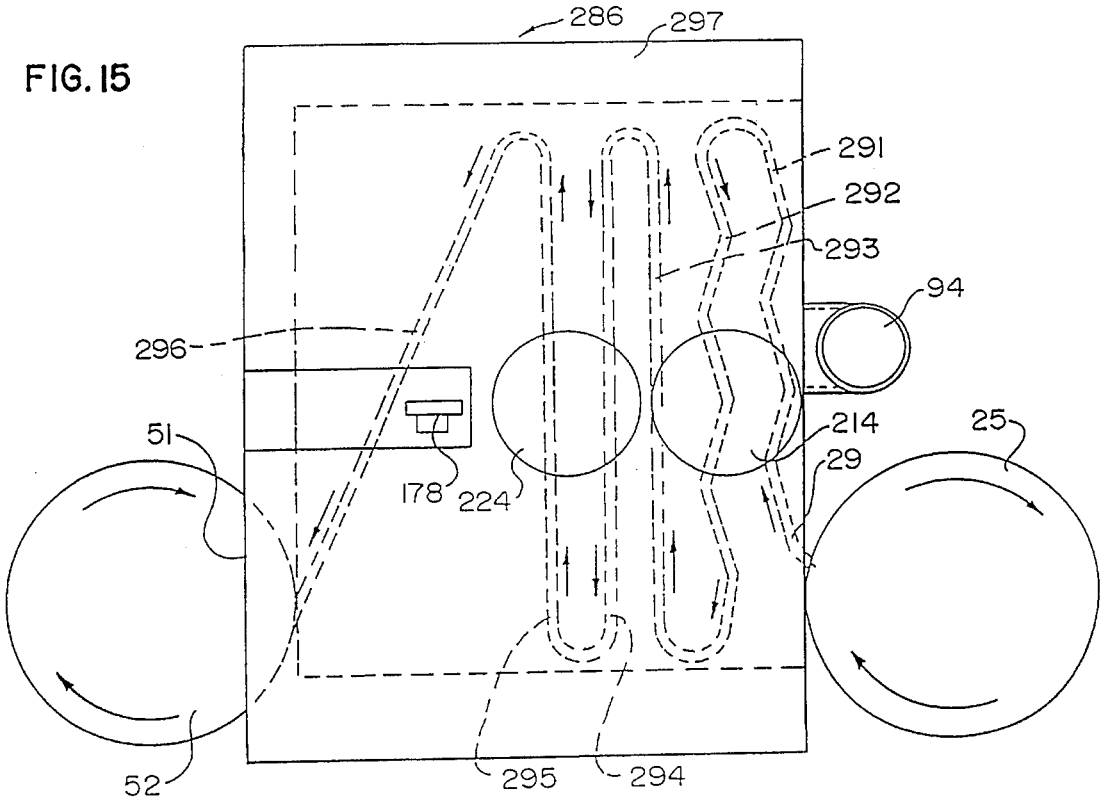
FIG. 15 gives a top plan view of a bottle-vial washer very similar to that of FIG. 14 except for narrower vials and also employing a zig-zag configuration in the first two path segments.

Alternately, the vials undergoing washing, may find use of the change piece indicated generally at 286 in FIG. 15. As seen there, the path segments in 291 to 296 have a smaller width formed in the sheet 297 than do the similar path segments 271 to 276 seen in FIG. 14. This clearly accommodates narrower vials and keeps them supported in an upright fashion. Furthermore, the first two path segments 291 and 292 have a slight zig-zag deviation from an absolutely straight line. Again, the resulting slight change of direction causes the vials, when moving on the belts underneath, to undergo a rotation and receive a thorough cleaning around their entire circumferences.

Figure 16:
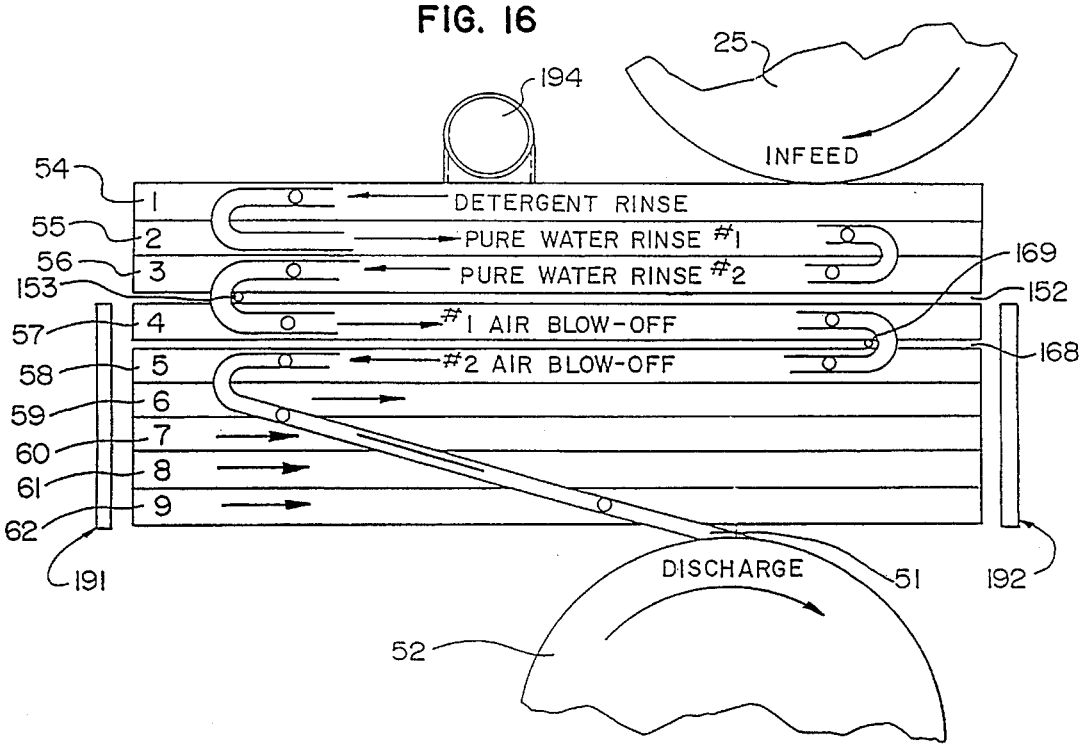
FIG. 16 gives a diagrammatic top plan view of the vial washers of FIGS. 14 or 15 showing the various stages of cleaning.

FIG. 16 illustrates the cleaning process that may find use for the change piece 265 of FIG. 14 or the piece 286 of FIG. 15. As seen there, the vials may undergo a detergent rinse on the first path propelled by the belt 54. On the second and third path segments overlying the belts 55 and 56, they receive two water rinses. They will then transfer over the gap 152 where their bottoms receive the blast of air from the jet 153. Traveling along the fourth and fifth path segments on the belts 57 and 58, the vials receive two streams of air to effectuate their drying. Between these two paths again lies the gap 168 and the bottom air jet 169.

The two blasts of air along the fourth and fifth path segments may suffice to completely dry the vials. In this situation, they may simply then move along the last path segment over the belts 59 to 62 to the discharge outlet 51 and onto the collection table 52.

In comparison to FIG. 4, the belts 59 to 62 all move to the right in FIG. 16. In FIG. 4, the belts 60 and 61 move to the left. Accordingly, the use of the change piece 265 of FIG. 14 or 286 (of FIG. 15) requires the change of direction of the belts 60 and 61 so that they move as indicated in FIG. 16. This would require the appropriate alteration to the wheels and gears discussed above with regards to FIG. 7. The alterations would concern the wheels 122, 125, 147, and 148 as well as the gears 120 and 121. In fact, a coupling between the belts 59 to 62 similar to the coupling 124, but on the left side and connecting the wheels 140, 147, and 148 could achieve the desired direction and speed of belt movement. Once adjusted in this fashion, however, the change piece 265 of FIG. 14 may freely interchange with the change piece of FIG. 15 without any further adjustments to the belts.

For a very simple rinse and drying, the equipment seen in the figures with an appropriate change piece could find use with just two passes. On the first, water rinses the vials. A blast of air dries them on the second. Used in this fashion, seven of the nine belts would become unnecessary. Adding the appropriate components will allow for its expansion into one of the units discussed above.

Accordingly, what is claimed is:

1. A method of washing vials comprising:

(A) moving said vials in a substantially horizontal direction;

(B) limiting the motion of said vials to a predetermined path, said path including (a) a plurality of path segments with substantially the entire length of each of said path segments being at a substantially constant distance to substantially the entire lengths of the others of said path segments and (b) connecting segments equal in number to one less than the number of said path segments, each of said connecting segments connecting two of said path segments said vials being substantially moved in opposite directions and at different speeds on two of said path segments to accumulate and bunch said vials; and (C) removing material from the exterior of said vials while on said path.

2. The method of claim 1 wherein each of said path segments is substantially straight.

3. The method of claim 2 wherein each of said connecting segments has a radius of curvature smaller than that of said path segments.

4. The method of claim 3 further applying a negative partial pressure to below said path segments.

5. The method of claim 3 wherein at least one of said path segments includes a slight deviation from being absolutely straight.

6. The method of claim 3 further including rotating said vials while moving along at least one of said path segments.

7. The method of claim 6 wherein said rotating is accomplished by moving said vials along a slight zig-zag configuration on said one particular path segment.

8. The method of claim 6 wherein said rotating is accomplished by moving said vial along a slight sinusoidal configuration on said at least one particular path segment.

9. The method of claim 3 wherein a sheet of substantially rigid material having an elongated slot therein defines said path segments and said connecting segments.

10. The method of claim 9 wherein said sheet is a first sheet, said first sheet is supported by a frame, and further including affixing and removing to and from said frame said first sheet and a second sheet having an elongated slot wherein different from said elongated slot in said first sheet.

11. The method of claim 10 wherein the elongated slot in said first sheet has a different width than the elongated slot in said second sheet.

12. The method of claim 3 wherein the removing of material from the exterior of said vials includes means for applying a liquid to said vials while on said predetermined path.

13. The method of claim 12 the removing of material further includes removing a liquid from said vials while on said predetermined path.

14. The method of claim 13 wherein the removing of material occurs at a plurality of locations along said predetermined path.

15. The method of claim 14 wherein the removing of material includes applying water to said vials while on said predetermined path.

16. The method of claim 15 wherein the removing of material includes applying a liquid detergent to said vials at a location on said predetermined path different than at which the water is applied.

17. The method of claim 16 wherein the removing of material includes applying a stream of air to said vials while on said predetermined path.

18. The method of claim 17 wherein the removing of material includes applying negative partial pressure in the vicinity of said vials while on said predetermined path.

19. The method of claim 17 wherein the air is applied at a location along the first half of the length of said predetermined path.

20. The method of claim 16 further including changing the height above the bottoms of said vials at which the liquid is applied.

21. A method of washing vials comprising:

(A) moving said vials;

(B) limiting the motion of said vials to a predetermined path formed as an elongated opening in a substantially rigid sheet of material, said opening having a width slightly larger than said vials;

(C) supporting said vials in an upright position in said opening; and (D) removing material from the exterior of said vials while on said path.

22. The method of claim 21 wherein said sheet is a first sheet, said first sheet is supported by a frame, and further including affixing and removing to and from said frame said first sheet and a second sheet having an elongated slot wherein different from said elongated slot in said first sheet.

23. The method of claim 22 wherein the elongated slot in said first sheet has a different width than the elongated slot in said second sheet.

24. The method of claim 23 wherein said path includes a plurality of path segments and connecting segments between said path segments and wherein each of said path segments is substantially straight.

25. The method of claim 24 wherein each of said connecting segments has a radius of curvature smaller than that of said path segments.

26. The method of claim 25 further including applying a negative partial pressure to below said path segments.

27. The method of claim 25 wherein at least one of said path segments includes a slight deviation from being absolutely straight.

28. The method of claim 25 further including rotating said vials while moving along at least one of said path segments.

29. The method of claim 28 wherein said rotating is accomplished by moving said vials along a slight zig-zag configuration on said one particular path segment.

30. The method of claim 28 wherein said rotating is accomplished by moving said vial along a slight sinusoidal configuration on said at least one particular path segment.

31. The method of claim 23 wherein the removing of material from the exterior of said vials includes for applying a liquid to said vials while on said predetermined path.

32. The method of claim 31 the removing of material further includes removing a liquid from said vials while on said predetermined path.

33. The method of claim 32 wherein the removing of material occurs at a plurality of locations along said predetermined path.

34. The method of claim 33 wherein the removing of material includes applying water to said vials while on said predetermined path.

35. The method of claim 34 wherein the removing of material includes applying a liquid detergent to said vials at a location on said predetermined path different than at which the water is applied.

36. The method of claim 35 wherein the removing of material includes applying a stream of air to said vials while on said predetermined path.

37. The method of claim 36 wherein the removing of material includes applying negative partial pressure in the vicinity of said vials while on said predetermined path.

38. The method of claim 36 wherein the air is applied at a location along the first half of the length of said predetermined path.

39. The method of claim 35 further including changing the height above the bottoms of said vials at which the liquid is applied.

40. A method for controllably moving vials comprising:

(A) moving said vials in a substantially horizontal direction;

(B) limiting the motion of said vials to a predetermined path, said path including (a) a plurality of path segments with substantially the entire length of each of said path segments being at a substantially constant distance to substantially the entire lengths of the others of said path segments and (b) connecting segments equal in number to one less than the number of said path segments, each of said connecting segments connecting two of said path segments, said vials being moved in substantially opposite directions and at different speeds on two of said path segments to accumulate and bunch said vials.

41. The method of claim 40 wherein each of said path segments is substantially straight.

42. The method of claim 41 wherein each of said connecting segments has a radius of curvature smaller than that of said path segments.

43. The method of claim 42 wherein at least one of said path segments includes a slight deviation from being absolutely straight.

44. The method of claim 42 wherein said rotating is accomplished by moving said vials along a slight zig-zag configuration on said one particular path segment.

45. The method of claim 42 wherein said rotating is accomplished by moving said vial along a slight sinusoidal configuration on said at least one particular path segment.

46. The method of claim 42 wherein a sheet of substantially rigid material having an elongated slot therein defines said path segments and said connecting segments.

47. The method of claim 46 wherein said sheet is a first sheet, said first sheet is supported by a frame, and further including affixing and removing to and from said frame said first sheet and a second sheet having an elongated slot wherein different from said elongated slot in said first sheet.

48. The method of claim 47 wherein the elongated slot in said first sheet has a different width than the elongated slot in said second sheet.

49. A method of controllably moving vials comprising:

(A) moving said vials;

(B) limiting the motion of said vials to a predetermined path formed as an elongated opening in a substantially rigid sheet of material, said opening having a width slightly larger than said vials; and (C) supporting said vials in an upright position in said opening.

50. The method of claim 49 wherein said sheet is a first sheet, said first sheet is supported by a frame, and further including affixing and removing to and from said frame said first sheet and a second sheet having an elongated slot therein different from said elongated slot in said first sheet.

51. The method of claim 50 wherein the elongated slot in said first sheet has a different width than the elongated slot in said second sheet.

52. The method of claim 51 wherein each of said path segments is substantially straight.

53. The method of claim 52 wherein each of said connecting segments has a radius of curvature smaller than that of said path segments.

54. The method of claim 53 wherein at least one of said path segments includes a slight deviation from being absolutely straight.

55. The method of claim 53 wherein said rotating is accomplished by moving said vials along a slight zig-zag configuration on said one particular path segment.

56. The method of claim 53 wherein said rotating is accomplished by moving said vial along a slight sinusoidal configuration on said at least one particular path segment.

57. A method of washing vials comprising:

(A) moving said vials;

(B) limiting the motion of said vials to a predetermined path, said path including (a) a plurality of path segments with substantially the entire length of each of said path segments being at a substantially constant distance to substantially the entire lengths of the others of said path segments and (b) connecting segments equal in number to one less than the number of said path segments, each of said connecting segments connecting two of said path segments;

(C) rotating said vials moving along at least one particular path segment, said rotating of said vials accomplished by a slight zig-zag configuration of said one particular path segment; and (D) removing material from the exterior of said vials while on said path.

58. A method of washing vials comprising:

(A) moving said vials;

(B) limiting the motion of said vials to a predetermined path, said path including (a) a plurality of path segments with substantially the entire length of each of said path segments being at a substantially constant distance to substantially the entire lengths of the others of said path segments and (b) connecting said path segments, each of said connecting segments connecting two of said path segments;

(C) rotating said vials while moving along at least one particular path segment, said rotating accomplished by a slight sinusoidal configuration to said at least one particular path segment.

(D) removing material from the exterior of said vials while on said path.

59. A method of controllably moving vials comprising:

(A) moving said vials;

(B) limiting motion of said vials to a predetermined path, said path including (a) a plurality of path segments with substantially the entire length of each of said path segments being at a substantially constant distance to substantially the entire lengths of the others of said path segments and (b) connecting segments equal in number to one less than the number of said path segments, each of said connecting segments connecting two of said path segments; and (C) rotating said vials while moving along at least one particular path segment, said rotating of said vials accomplished by a slight zig-zag configuration of said one particular path segment.

60. A method for controllably moving vials comprising:

(A) moving said vials;

(B) limiting the motion of said vials to a predetermined path, said path including (a) a plurality of path segments with substantially the entire length of each of said path segments being at a substantially constant distance to substantially the entire lengths of the others of said path segments and (b) connecting segments equal in number to one less than the number of said path segments, each of said connecting segment connecting two of said path segments; and (C) rotating said vials while moving along at least one particular path segment, said rotating accomplished by a slight sinusoidal configuration of said one particular path segment.

* * * * *